US010192506B2

(12) United States Patent
Wu et al.

(10) Patent No.: US 10,192,506 B2
(45) Date of Patent: Jan. 29, 2019

(54) DRIVING METHOD FOR DISPLAY PANEL, TIMING CONTROLLER AND LIQUID CRYSTAL DISPLAY

(71) Applicant: Shenzhen China Star Optoelectronics Technology Co., Ltd., Shenzhen, Guangdong (CN)

(72) Inventors: Yu Wu, Guangdong (CN); Lei Wang, Guangdong (CN)

(73) Assignee: Shenzhen China Star Optoelectronics Technology Co., Ltd, Shenzhen, Guandong (CN)

( * ) Notice: Subject to any disclaimer, the term of this patent is extended or adjusted under 35 U.S.C. 154(b) by 67 days.

(21) Appl. No.: 15/533,015

(22) PCT Filed: Apr. 20, 2017

(86) PCT No.: PCT/CN2017/081238

§ 371 (c)(1),
(2) Date: Jun. 3, 2017

(87) PCT Pub. No.: WO2018/170984

PCT Pub. Date: Sep. 27, 2018

(65) Prior Publication Data

US 2018/0268769 A1 Sep. 20, 2018

(51) Int. Cl.
*G09G 3/36* (2006.01)

(52) U.S. Cl.
CPC ..... *G09G 3/3677* (2013.01); *G09G 3/3688* (2013.01); *G09G 2310/08* (2013.01); *G09G 2320/041* (2013.01); *G09G 2330/021* (2013.01)

(58) Field of Classification Search
CPC ..... G09G 3/3677; G09G 3/3688; G09G 2310/08; G09G 2320/041; G09G 2330/021; G09G 3/36
See application file for complete search history.

(56) References Cited

U.S. PATENT DOCUMENTS 7,339,570 B2 * 3/2008 Kubota ..... G09G 3/2011 345/100
8,749,707 B2 6/2014 White et al.
(Continued)

FOREIGN PATENT DOCUMENTS

CN 104934010 A 9/2015
CN 105047176 A 11/2015
CN 105096898 A 11/2015

*Primary Examiner* — Lun-Yi Lao
*Assistant Examiner* — Jarurat Suteerawongsa
(74) *Attorney, Agent, or Firm* — Andrew C. Cheng

(57) ABSTRACT

The present invention provides a driving method for a display panel, a timing controller and a liquid crystal display. The method includes: when detecting that an image frame to be displayed is an overloaded image, a timing controller switches an operation frequency from a first frequency to a second frequency; outputting a timing control signal to a source driver with the second frequency such that after the source driver receives the timing control signal, the source driver outputs the data driving signal having a lower frequency to drive the display panel to display the overloaded image; wherein the first frequency is higher than the second frequency. Through the above way, the output power consumption of the source driver when displaying an overloaded image is decreased, and avoid rising temperature to affect the display quality.

9 Claims, 3 Drawing Sheets

(56) References Cited

U.S. PATENT DOCUMENTS

| | | | | |
|---|---|---|---|---|
| 2010/0245316 | A1* | 9/2010 | Cheng | G09G 3/3648<br>345/211 |
| 2014/0146033 | A1* | 5/2014 | Koyama | G09G 3/3655<br>345/212 |
| 2015/0279294 | A1* | 10/2015 | Inada | G09G 3/3614<br>345/693 |
| 2015/0340014 | A1* | 11/2015 | Kim | G09G 5/18<br>345/212 |

* cited by examiner

DRIVING METHOD FOR DISPLAY PANEL, TIMING CONTROLLER AND LIQUID CRYSTAL DISPLAY

BACKGROUND OF THE INVENTION

1. Field of the Invention

The present invention relates to a display technology field, and more particularly to a driving method for a display panel, a timing controller and a liquid crystal display.

2. Description of Related Art

The most commonly used liquid crystal display panel is a thin-film transistor (TFT) liquid crystal display. The TFT liquid crystal display adopts a source driver to provide a driving voltage corresponding to an image to be displayed to a data line in order to drive a display panel to display the image.

However, when a liquid crystal display requires displaying an overloaded image, that is, when driving the overloaded image, the power consumption of the source driver become large. At this time, the output power consumption of the source driver for forming and maintaining the driving voltage become large. At the same time, a driving mode according to a normal liquid crystal display, a switching frequency of a high-low voltage of the data line is faster so that the generated heat becomes large. If the heat dissipation way is not good, the temperature will slowly increase so as to affect the display quality of the display.

SUMMARY OF THE INVENTION

The present invention provides a driving method for a display panel, a timing controller and a liquid crystal display, which can decrease the output power consumption of the source driver when displaying an overloaded image, and avoid rising temperature to affect the display quality.

The first aspect of the present invention is to provide a driving method for display panel, comprising:

when detecting that an image frame to be displayed is an overloaded image, a timing controller switches an operation frequency from a first frequency to a second frequency;

the timing controller outputs a timing control signal to a source driver with the second frequency such that after the source driver receives the timing control signal, the source driver outputs the data driving signal having a lower frequency to drive the display panel to display the overloaded image;

wherein, the first frequency is higher than the second frequency;

wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image.

The second aspect of the present invention is to provide a timing controller of a display panel, comprising:

a control circuit for outputting a first frequency switching instruction when an image frame to be displayed is detected as an overloaded image;

a signal generation circuit connected with the control circuit for switching an operation frequency from a first frequency to a second frequency according to the first frequency switching instruction, and using the second frequency to output the timing control signal to the source driver such that after the source driver receives the timing control signal, the source driver outputs the data driving signal having a lower frequency to drive the display panel to display the overloaded image;

wherein, the first frequency is higher than the second frequency; and wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image.

The third aspect of the present invention is to provide a liquid crystal display, comprising:

a timing controller for outputting a timing control signal;

a display driving circuit including a source driver and a gate driver for receiving the timing control signal, wherein the source driver generates a data driving signal according to the timing control signal, and the gate driver generates a scanning driving signal; and a liquid crystal display panel including multiple data lines, multiple scanning lines and multiple pixel units, wherein the scanning line receives the scanning driving signal and the data line receives the data driving signal in order to control a corresponding pixel unit to display;

wherein, the timing controller comprises:

a control circuit for outputting a first frequency switching instruction when an image frame to be displayed is detected as an overloaded image;

a signal generation circuit connected with the control circuit for switching an operation frequency from a first frequency to a second frequency in a switching moment of adjacent frames according to the first frequency switching instruction, and using the second frequency to output the timing control signal to the source driver such that after the source driver receives the timing control signal, the source driver outputs the data driving signal having a lower frequency to drive the display panel to display the overloaded image;

the control circuit is further used for outputting a second frequency switching instruction when an image frame to be displayed is detected as a non-overloaded image.

In the above proposals, when the timing controller detects that an image frame to be displayed is an overloaded image, switching an operation frequency from a first frequency to a second frequency; outputting a timing control signal with the second frequency such that after the source driver receives the timing control signal, the source driver outputs the data driving signal having a lower frequency to drive the display panel so that the output power consumption of the source driver when displaying an overloaded image is decreased, and avoid rising temperature to affect the display quality.

DETAILED DESCRIPTION OF THE PREFERRED EMBODIMENT

The following description is for the purpose of illustration not for limitation, and specific details are proposed such as the system configuration, the interface, and the technique in order to completely understand the present application. However, the person of ordinary skill in the art should know, in other embodiments without these specific details can also achieve the present application. In other instances, well-known devices, circuits and methods are omitted to prevent the unnecessary details hindering the description of the present application.

Figure 1:
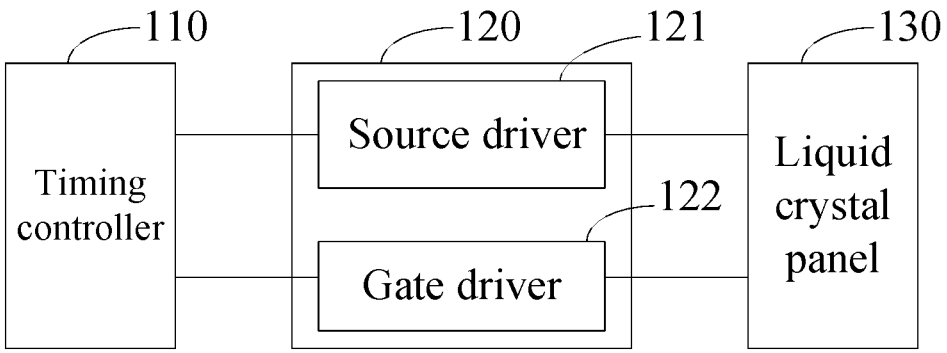
FIG. 1 is a schematic structure diagram of a liquid crystal display according to an embodiment of the present invention.
Figure 2:
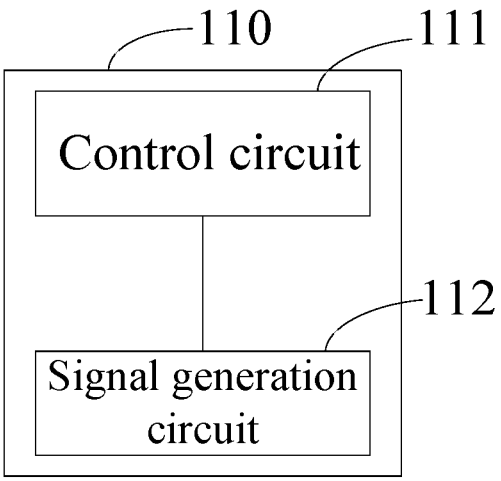
FIG. 2 is a schematic diagram of a timing controller 110 shown in FIG. 1.

With reference to FIG. 1 and FIG. 2, FIG. 1 is a schematic structure diagram of a liquid crystal display according to an embodiment of the present invention, and FIG. 2 is a schematic diagram of a timing controller. The liquid crystal display is a TFT liquid crystal display. In the present embodiment, the liquid crystal display includes a timing controller (TCON) 110, a display driving circuit 120 and a liquid crystal display panel 130. Wherein, the display driving circuit further includes a source driver 122 and a gate driver 123.

The timing controller 110 is used for generating timing control signals. Specifically, transforming an image data signal, a control signal and a clock signal transmitted from a driving board (AD board) to a data signal, a control signal and a clock signal suitable for the display driving circuit 120. Wherein, the timing controller 110 outputs corresponding timing control signals to the source driver 122 and the gate driver 123 of the display driving circuit 120.

The display driving circuit 120 specifically receives the timing control signals, and generates driving signals according to the timing control signals.

Wherein, the source driver 122 is used for storing image data signal of an image frame to be displayed in a cache under the control of the timing controller 110, and cooperates with turning on of the gate scanning signal to convert image data signal to a driving voltage to be outputted to a pixel in order to drive a data line in a display panel.

The gate driver 123 is used for receiving a control signal outputted from the timing controller 110 to sequentially output appropriate voltages to gate lines in order to drive the gate lines of the display panel.

The liquid crystal panel 130 is used for realizing a display of an image frame to be displayed under the driving of the source driver 120 and the gate driver 130.

Specifically, the timing controller 110 includes a control circuit 111 and a signal generation circuit 112 connected with each other. The timing controller 110 preset two operation frequencies, respectively a first frequency and a second frequency. Wherein, the first frequency is higher than the second frequency. The first frequency is an operation frequency of the timing controller 110 under a normal display. The second frequency is an operation frequency of the timing controller 110 when displaying an overloaded image. In one embodiment, the second frequency is one half of the first frequency.

An overloaded image is defined as: when the timing controller 110 adopts the first frequency as the operation frequency to control the source driver 122 to display an image frame to be displayed, the power consumption of the source driver 122 exceeds a preset power consumption value, and the image frame to be displayed is an overloaded image.

When the timing controller 110 displays a normal image, using the first frequency to operate, when detecting that an overloaded image is required, switching to the second frequency to operate. The switching method for the operation frequency is as following:

The control circuit 111 is used for detecting that an image frame to be displayed is an overloaded image, outputting a first frequency switching instruction. Specifically, when the timing controller 110 receives the data of the image frame to be displayed, the control circuit 111 compares the data of the image frame to be displayed with an overloaded image stored internally. If the control circuit determines that the two data are similar or the same, determining that the frame image is an overloaded image.

The signal generation circuit 112 is used for switching the operation frequency from the first frequency to the second frequency according to the first frequency switching instruction, and using the second frequency to output timing control signals to a display driving circuit such that the display driving circuit 120 drives the liquid crystal display panel to display the overloaded image according to the timing control signal. Specifically, the signal generation circuit 112 can switch the operation frequency from the first frequency to the second frequency at a switching moment (V-blank time, that is, when finishing displaying a pervious image frame of the overloaded image) of adjacent frames.

Because, the second frequency is lower than the first frequency, the timing control signals such as TP1 (an output signal of data from the source driver to the display panel), STV (turning-on signal of the gate electrode, that is, a starting of a frame), and CKV (clock signal) when the timing controller 110 outputs the overloaded image to the display driving circuit using the second frequency, that is, the frequency of the timing control signal is decreased as the second frequency. Accordingly, when the source driver 122 drives and displays the overloaded image, the frequency of the driving circuit is decreased (a changing period of high-low voltages in the driving signal becomes longer) so that the output power consumption of the source driving circuit is decreased in order to avoid the heat generation from becoming great because of high changing frequency of voltages so as to affect the display quality.

Figure 3:
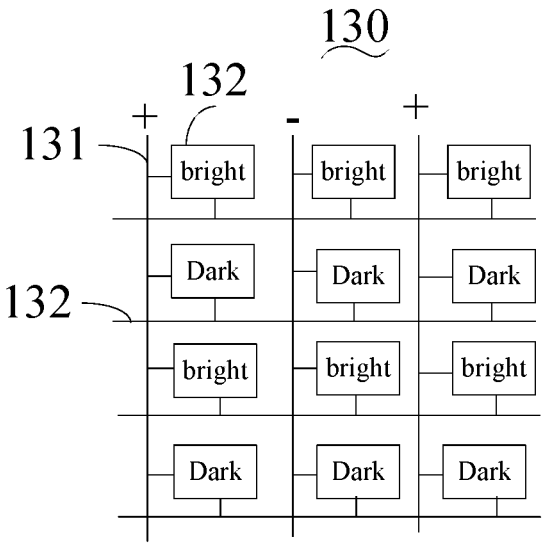
FIG. 3 is a schematic diagram of a portion of a liquid crystal display panel 130 shown in FIG. 1 in an application field.

For example, as shown in FIG. 3, the liquid crystal display panel 130 includes multiple data lines 131, multiple scanning lines 133 and multiple pixel units 132. Wherein, the data lines 131 and the scanning lines 133 can be a vertical and horizontal arrangement. The pixel unit 132 is connected with a corresponding data line 131 and a scanning line 133 in order to receive the signals outputted from the data lines 131 and the scanning lines 133 to realize a display. The pixel unit 132 can include a RGB three primary colors sub-pixel unit. Specifically, the gate driver 123 outputs the scanning driving signal to the scanning line 133. The source driver 122 outputs a data driving signal to the data line 131. Wherein, the first column of the data lines outputs the data signal to a R (red) pixel unit 132, the second column of the data lines outputs the data signal to the G (green) pixel unit, and the third column of the data lines outputs the data signal to the B (Blue) pixel unit 132.

Figure 4:
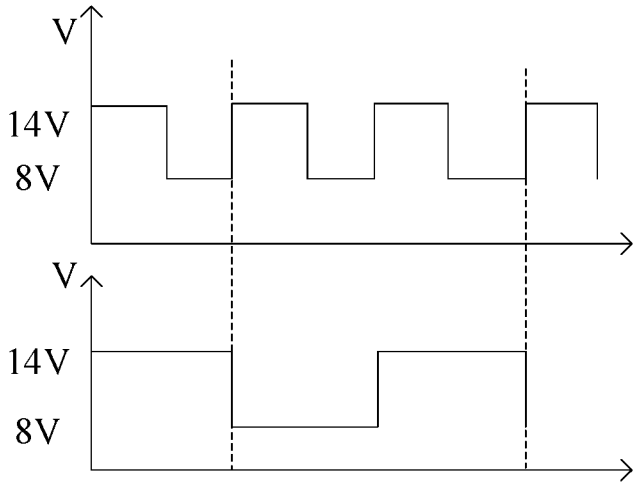
FIG. 4 is a waveform diagram of a display driving circuit when the timing controller 110 adopts different operation frequencies in an application field shown in FIG. 3.

Using the first column of the data lines 131 as an example, if a bright status corresponds to 14V, and a dark status corresponds to 8V. At this time, the timing controller 110 adopts the first frequency to perform driving and controlling. The waveform of the voltage change of the data line is an upper waveform diagram as shown in FIG. 4. If the timing controller detects that the image is an overloaded image (a pattern), the operation frequency is decreased to the second frequency. At this time, the waveform of the voltage change of the data line is a lower waveform diagram as shown in FIG. 4. Obviously, the frequency of the voltage change of the data line is decreased.

Furthermore, after the timing controller 110 controls to display the overloaded image, if a following image is a normal display image, switching the operation frequency back to the first frequency, specifically as following:

the control circuit 111 is further used for outputting a second frequency switching instruction when the image frame to be displayed is a non-overloaded image;

the signal generation circuit 112 is further used for switching the operation frequency from the second frequency to the first frequency according to the second frequency switching instruction, and using the first frequency to output the timing control signal to the source driver 122 such that after the source driver 122 receives the timing control signal, the source driver 122 outputs corresponding data driving signal to drive the display panel to display the non-overloaded image. Specifically, the signal generation circuit 112 can finish the switching of the operation frequency in a switching moment of adjacent frames.

At this time, because the operation frequency of the timing controller 110 is restored to the normal first frequency, the driving signal outputted from the source driver is also restored to a normal status (as the upper waveform diagram shown in FIG. 4).

Because a general video image is a non-overloaded image, the method of the present embodiment can ensure a dynamic display effect of a normal image and decrease the power consumption of an overloaded image at the same time.

It can be understood that in a specific application, the control circuit and the signal generation circuit of the timing controller can be integrated in a same chip or using a same circuit to realize, the present invention is not limited here.

Figure 5:
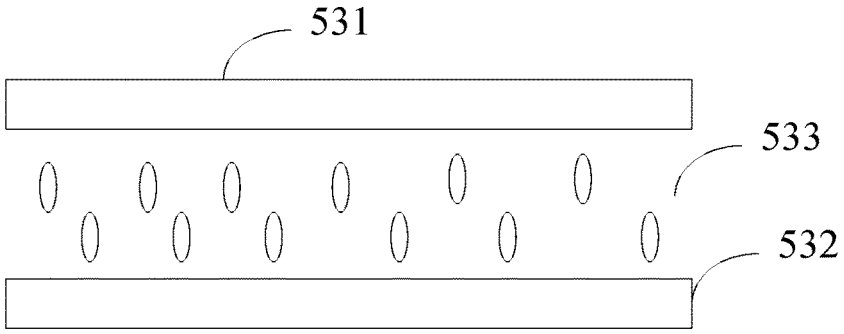
FIG. 5 is schematic diagram of a liquid crystal panel of a liquid crystal display according to another embodiment of the present invention.

In another embodiment of the liquid crystal display, with reference to FIG. 5, the liquid crystal display panel 530 includes an array substrate 531, a color filter substrate 532 and liquid crystals 533 clamped between the array substrate 531 and the color filter substrate 532. The array substrate 531 includes the multiple data lines the multiple scanning lines arranged vertically and horizontally, and the multiple pixel units. Specifically as shown in FIG. 3, the data lines and the scanning lines respectively receives the data driving signals and the scanning driving signals outputted from the display driving circuit 120 in order to drive the pixel unit to perform a display.

Besides, the timing controller is not limited to be applied in a liquid crystal display, in another embodiment, the timing controller can be applied in a display device adopting a source driver to output driving signals to the data line of the display panel.

Figure 6:
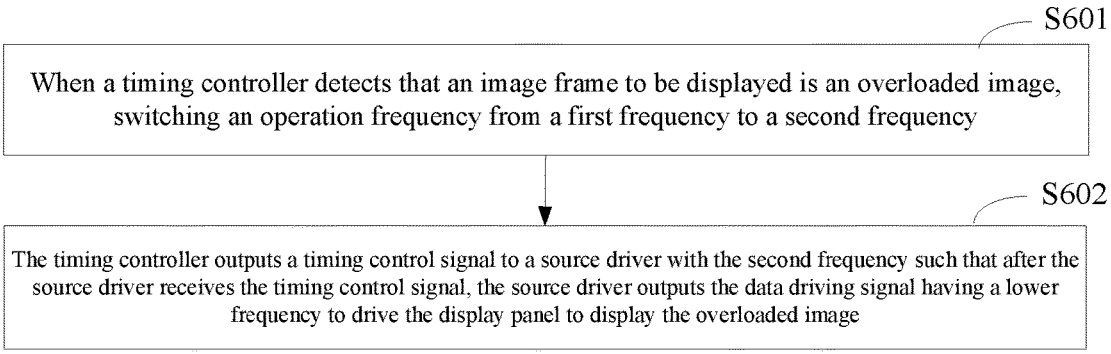
FIG. 6 is a flow chart of a driving method for a display panel according to an embodiment of the present invention.

With reference to FIG. 6, and FIG. 6 is a flow chart of a driving method for a display panel according to an embodiment of the present invention. The present method can be applied in the display driving circuit of the above embodiments, the driving method can be executed by the timing controller of the above embodiments. The method specifically includes:

S601: when a timing controller detects that an image frame to be displayed is an overloaded image, switching an operation frequency from a first frequency to a second frequency.

For example, when the timing controller receives the data of the image frame to be displayed, the timing controller compares the data of the image frame to be displayed with the data of an overloaded image stored internally. If the timing controller determines that the two data are similar or the same, determining that the frame image is an overloaded image.

S602: the timing controller outputs a timing control signal to a source driver with the second frequency such that after the source driver receives the timing control signal, the source driver outputs the data driving signal having a lower frequency to drive the display panel to display the overloaded image.

Figure 7:
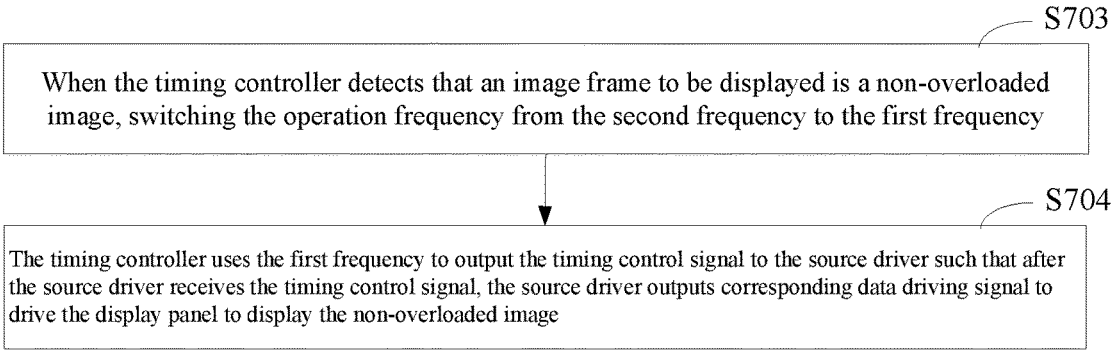
FIG. 7 is a partial of flow chart of a driving method for a display panel according to another embodiment of the present invention.

Wherein, the first frequency is higher than the second frequency, for example, the second frequency is one half of the first frequency.

wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image With reference to FIG. 7, and FIG. 7 is a partial of flow chart of a timing control method for a display driving circuit according to another embodiment of the present invention. The difference between the present embodiment and the above embodiment is that after executing the above steps S601-S602, the method of the present embodiment further comprises:

S703: when the timing controller detects that an image frame to be displayed is a non-overloaded image, switching the operation frequency from the second frequency to the first frequency.

S704: the timing controller uses the first frequency to output the timing control signal to the source driver such that after the source driver receives the timing control signal, the source driver outputs corresponding data driving signal to drive the display panel to display the non-overloaded image.

Wherein, the timing controller finishes switching of the first frequency and the second frequency in the switching moment of adjacent frames.

In the above solution, when the timing controller detects an overloaded image decreasing the operation frequency from the first frequency to the second frequency in order to output the timing control signal with the second frequency such that the source driver receiving the timing control signal output the driving signal having a lower frequency to the display panel so as to decrease the output power consumption of the source driver when displaying an overloaded image. Besides, because the frequency of the driving signal is decreased, the rising of the temperature to affect the display quality can be avoided.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A liquid crystal display, comprising:

a timing controller for outputting a timing control signal;

a display driving circuit including a source driver and a gate driver for receiving the timing control signal, wherein the source driver generates a data driving signal according to the timing control signal, and the gate driver generates a scanning driving signal; and a liquid crystal display panel including multiple data lines, multiple scanning lines and multiple pixel units, wherein the scanning line receives the scanning driving signal and the data line receives the data driving signal in order to control a corresponding pixel unit to display;

wherein, the timing controller comprises:

a control circuit for outputting a first frequency switching instruction when an image frame to be displayed is detected as an overloaded image;

a signal generation circuit connected with the control circuit for switching an operation frequency from a first frequency to a second frequency in a switching moment of adjacent frames according to the first frequency switching instruction, and using the second frequency to output the timing control signal to the source driver such that after the source driver receives the timing control signal, the source driver outputs the data driving signal having a lower frequency to drive the display panel to display the overloaded image;

the control circuit is further used for outputting a second frequency switching instruction when an image frame to be displayed is detected as a non-overloaded image;

the signal generation circuit is further used for switching the operation frequency from the second frequency to the first frequency according to the second frequency switching instruction, and using the first frequency to output the timing control signal to the source driver such that after the source driver receives the timing control signal, the source driver outputs corresponding data driving signal to drive the display panel to display the non-overloaded image;

wherein, the second frequency is one half of the first frequency; and wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image.

2. The liquid crystal display according to claim 1, wherein, the signal generation circuit is used for switching the operation frequency from the second frequency to the first frequency in a switching moment of adjacent frames.

3. The liquid crystal display according to claim 1, wherein, the liquid crystal display panel includes an array substrate, a color filter substrate and liquid crystals clamped between the array substrate and the color filter substrate, and the multiple data lines, the multiple scanning lines and the multiple pixel units are disposed on the array substrate.

4. An LCD display driving method for an LCD display panel, comprising:

a timing controller detects that an image frame to be displayed is an overloaded image, the timing controller switches an operation frequency from a first frequency to a second frequency in a switching moment of adjacent frames; and the timing controller outputs a timing control signal to a source driver with the second frequency such that after the source driver receives the timing control signal, the source driver outputs the data driving signal having a lower frequency to drive the display panel to display the overloaded image;

wherein, the second frequency is one half of the first frequency; and wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image.

5. The driving method according to claim 4, wherein, after the step of the timing controller outputting a timing control signal to a source driver with the second frequency, the method further comprises:

when detecting that an image frame to be displayed is a non-overloaded image, the timing controller switches the operation frequency from the second frequency to the first frequency; and the timing controller uses the first frequency to output the timing control signal to the source driver such that after the source driver receives the timing control signal, the source driver outputs corresponding data driving signal to drive the display panel to display the non-overloaded image.

6. The driving method according to claim 5, wherein, the step of the timing controller switching the operation frequency from the second frequency to the first frequency comprises:

the timing controller switches the operation frequency from the second frequency to the first frequency in a switching moment of adjacent frames.

7. A timing controller of a display panel, comprising:

a control circuit for outputting a first frequency switching instruction when an image frame to be displayed is detected as an overloaded image;

a signal generation circuit connected with the control circuit for switching an operation frequency from a first frequency to a second frequency in a switching moment of adjacent frames according to the first frequency switching instruction, and using the second frequency to output the timing control signal to the source driver such that after the source driver receives the timing control signal, the source driver outputs the data driving signal having a lower frequency to drive the display panel to display the overloaded image;

wherein, the second frequency is one half of the first frequency; and wherein the overloaded image is defined as when the timing controller adopts the first frequency as the operation frequency to control the source driver to display an image frame to be displayed, the power consumption of the source driver exceeds a preset power consumption value, and the image frame to be displayed is an overloaded image.

8. The timing controller according to claim 7, wherein, the signal generation circuit is further used for switching the operation frequency from the second frequency to the first frequency according to the second frequency switching instruction, and using the first frequency to output the timing control signal to the source driver such that after the source driver receives the timing control signal, the source driver outputs corresponding data driving signal to drive the display panel to display the non-overloaded image.

9. The timing controller according to claim 8, wherein, the signal generation circuit is used for switching the operation frequency from the second frequency to the first frequency in a switching moment of adjacent frames.

* * * * *